US009353721B2

(12) United States Patent
Eberle et al.

(10) Patent No.: US 9,353,721 B2
(45) Date of Patent: May 31, 2016

(54) WORK IMPLEMENT WITH AN INTERNAL COMBUSTION ENGINE

(71) Applicant: ANDREAS STIHL AG & CO. KG, Waiblingen (DE)

(72) Inventors: Christian Eberle, Korb (DE); Claus Naegele, Stuttgart (DE); Markus Weinig, Waiblingen (DE)

(73) Assignee: ANDREAS STIHL AG & CO. KG, Waiblingen (DE)

( * ) Notice: Subject to any disclaimer, the term of this patent is extended or adjusted under 35 U.S.C. 154(b) by 0 days.

(21) Appl. No.: 14/303,972

(22) Filed: Jun. 13, 2014

(65) Prior Publication Data

US 2014/0366828 A1 Dec. 18, 2014

(30) Foreign Application Priority Data

Jun. 13, 2013 (DE) ..... 10 2013 009 891

(51) Int. Cl.
*F02N 15/00* (2006.01)
*F02B 63/02* (2006.01)
(Continued)

(52) U.S. Cl.
CPC ..... *F02N 15/003* (2013.01); *B27B 17/083* (2013.01); *F02B 63/02* (2013.01);
(Continued)

(58) Field of Classification Search
CPC ..... F02B 63/02; B27B 17/083; B27B 17/00; F02M 1/02; F02M 35/1017; F02M 1/08; F02D 2400/06; F02D 2009/0203; F02D 2009/0208; F02D 11/04; F02N 3/02; F02N 5/02; F02N 11/10; F02N 11/105; F02N 19/00; F02N 1/005
USPC ..... 123/179.1, 185.1, 185.14, 185.3; 173/170, 216; 192/42–46, 103 B; 74/501.6, 575
See application file for complete search history.

(56) References Cited

U.S. PATENT DOCUMENTS 3,664,390 A 5/1972 Mattsson et al.
4,672,929 A * 6/1987 Wissmann et al. ..... 123/179.18
(Continued)

FOREIGN PATENT DOCUMENTS

DE 33 08 400 A1 9/1983
DE 10 2012 015 814 A1 5/2014
(Continued)

OTHER PUBLICATIONS

German Search Report, Appl. No. 14002010.8-1709, Nov. 24, 2014, 8 pgs.

*Primary Examiner* — Stephen K Cronin
*Assistant Examiner* — Long T Tran
(74) *Attorney, Agent, or Firm* — Paul D. Strain, Esq.; Strain & Strain PLLC

(57) ABSTRACT

A work implement has an internal combustion engine that drives a tool of the work implement via a clutch. The clutch has at least one driving element which is operatively connected to the internal combustion engine and at least one output element which is operatively connected to the tool. The internal combustion engine has a starting device with a starting position and an operating position. To avoid unintentional rotation of the output element when starting the internal combustion engine, the work implement has a blocking device with a detent pawl. In an actuated position, the detent pawl projects into the movement path of the output element, limiting the rotation of the output element. In an unactuated position, the detent pawl releases the output element. The starting device has an actuating device which, in the starting position, keeps the detent pawl in the actuated position.

14 Claims, 5 Drawing Sheets

(51) Int. Cl.

| | |
|---|---|
| ***B27B 17/08*** | (2006.01) |
| ***F02N 15/10*** | (2006.01) |
| ***F02N 15/02*** | (2006.01) |
| ***F02M 1/02*** | (2006.01) |
| *F02N 3/02* | (2006.01) |

(52) U.S. Cl.
CPC ..... *F02M 1/02* (2013.01); *F02N 15/026* (2013.01); *F02N 15/027* (2013.01); *F02N 15/10* (2013.01); *F02N 3/02* (2013.01)

(56) References Cited

U.S. PATENT DOCUMENTS

| | | | | | |
|---|---|---|---|---|---|
| 4,782,593 | A * | 11/1988 | Kieser et al. | ..... | 30/382 |
| 5,063,812 | A * | 11/1991 | Mercier | ..... | 74/575 |
| 6,167,973 | B1 * | 1/2001 | Nagashima | ..... | 173/221 |
| 6,196,082 | B1 * | 3/2001 | Iwata | ..... | 74/501.6 |
| 7,407,018 | B2 * | 8/2008 | Sasaki | ..... | 173/170 |
| 7,712,448 | B2 * | 5/2010 | Zimmermann | ..... | 123/185.3 |
| 2002/0185352 | A1 * | 12/2002 | Husges | ..... | 192/42 |
| 2005/0051124 | A1 * | 3/2005 | Adam et al. | ..... | 123/179.1 |
| 2009/0126672 | A1 * | 5/2009 | Ostojic et al. | ..... | 123/193.2 |
| 2009/0193669 | A1 * | 8/2009 | Gorenflo | ..... | 30/382 |
| 2011/0048359 | A1 * | 3/2011 | Wenckel | ..... | 123/185.2 |
| 2012/0318236 | A1 * | 12/2012 | Kullik et al. | ..... | 123/437 |

FOREIGN PATENT DOCUMENTS

| | | |
|---|---|---|
| EP | 0 235 670 A2 | 9/1987 |
| FR | 2 570 017 A2 | 3/1986 |

* cited by examiner

WORK IMPLEMENT WITH AN INTERNAL COMBUSTION ENGINE

CROSS-REFERENCE TO RELATED PATENT APPLICATIONS

This application is based upon and claims the benefit of priority from prior German Patent Application No. 10 2013 009 891.2, filed Jun. 13, 2013, the entire contents of which are incorporated herein by reference in their entirety.

BACKGROUND

This application relates to a work implement with an internal combustion engine of the generic type. An exemplary embodiment includes a work implement having an internal combustion engine driving at least one tool of the work implement via a clutch. The clutch has at least one driving element which is operatively connected to the internal combustion engine and at least one output element which is operatively connected to the tool. The work implement has a starting device for the internal combustion engine, the starting device having a starting position and an operating position. The work implement further has a blocking device with a detent pawl which, in an actuated position, projects into the movement path of the output element and limits the rotation of the output element to less than one revolution and which, in an unactuated position, releases the output element. The starting device has an actuating device for the blocking device which, in the starting position of the starting device, keeps the detent pawl in the actuated position.

DE 33 08 400 A1 discloses a work implement, namely a motor-driven saw, which has a starting device. In order to ensure that the chain is braked when the starting device is in the starting position, a connection is provided between a throttle-holding part of the starting device and the braking device. When the starting position is engaged, the braking device is actuated and adjusted into the braked position.

It is one of several objects of this application to provide a work implement with an internal combustion engine of the type in question, in which it is ensured in a simple manner that the tool is not driven when starting the work implement.

SUMMARY OF PREFERRED EMBODIMENTS

This and other objects are achieved by a work implement with an internal combustion engine according to the present application.

In an exemplary embodiment, to ensure in a simple manner that the tool cannot revolve, a blocking device is provided with a detent pawl which, in an actuated position, projects into the movement path of the output element and limits the rotation of the output element to less than one revolution. The starting device has an actuating device for the blocking device. In the starting position of the starting device, the blocking device keeps the detent pawl in the actuated position. Because the output element is blocked by the detent pawl in the starting position of the starting device, the output element of the clutch cannot rotate. As a result, driving of the tool is prevented in a simple manner. A detent pawl can securely block the output element and absorb comparatively large forces. The blocking device can be constructed in a structurally simple manner, thus resulting in a simple construction of the work implement. Because the starting device is adjusted into the starting position in order to start the internal combustion engine, the internal combustion engine does not operate during the adjustment of the detent pawl into the actuated position, and the forces exerted on the detent pawl by the output element are low.

In another embodiment, the blocking device is advantageously adjusted into the actuated position when the starting position is engaged. Accordingly, when the starting position is engaged, the actuating movement is used in order to adjust the blocking device into the actuated position. The detent pawl is in particular mounted pivotably. This results in a simple construction, and only low actuating forces are required in order to adjust the detent pawl into the actuated position.

In yet another embodiment, the detent pawl is advantageously spring-loaded by a resetting spring in the direction of the unactuated position of the blocking device. The starting device adjusts the detent pawl into the actuated position in particular counter to the force of the resetting spring. The resetting spring ensures that the detent pawl can be reset into the unactuated position when the starting position is in the operating position thereof. The resetting of the starting device into the operating position and the resetting of the detent pawl can take place independently of each other because of the resetting spring. In an advantageous manner, the connection between the actuating device and the detent pawl is designed in such a manner that the actuating device can adjust the detent pawl only in the direction of the actuated position. The movement of the actuating device back into the position associated with the operating position of the starting device advantageously does not cause the detent pawl to be reset.

In a further embodiment, damping spring is advantageously arranged in an operative connection between the actuating device and the detent pawl. The damping spring damps the contact of the detent pawl with the output element when the actuating device is adjusted into the starting position while the output element is already rotating. In addition, the damping spring permits an adjustment of the actuating device even if the detent pawl cannot be adjusted into the actuated position. This is the case in particular if the detent pawl is blocked by the output element itself, for example due to unfavorable rotational position of the output element. In this case, the detent pawl positions itself under prestress against the output element. As soon as the output element begins to rotate and moves out of the rotational position, the detent pawl can be pivoted into the actuated position thereof such that further rotation of the output element is avoided. Even in an unfavorable rotational position of the output element, it is thereby prevented that the output element can rotate by more than one revolution.

In yet another embodiment, the blocking device advantageously has a retaining contour which keeps the detent pawl in the actuated position independently of the position of the starting device when the output element is loaded in the driving direction. Accordingly, in order to reset the detent pawl into the unactuated position, in addition to the adjustment of the blocking device into the operating position, it is also necessary for the output element not to be loaded in the driving direction. As a result, the abrupt acceleration of the tool during the release of the starting device is prevented. As long as the output element is loaded in the driving direction, the detent pawl remains in the actuated position thereof. Only when the output element is not loaded in the driving direction can the detent pawl be adjusted back into the actuated position thereof in particular because of the force of the resetting spring. Instead of the resetting spring, the detent pawl can also be reset by the operator himself. Owing to the retaining contour, after the starting device is adjusted into the operating position, the operator first of all has to set a rotational speed below the coupling rotational speed, in particular the idling rotational speed, so that the detent pawl is or can be reset into the unactuated position thereof. Only then is the output element released and the work implement can be operated in the customary manner.

In still a further embodiment, a simple structural construction is produced if the detent pawl interacts with a receptacle of the output element when the output element is blocked. The output element has in particular a plurality of receptacles arranged in a rotationally symmetrical manner with respect to the axis of rotation of the output element. As a result, the possible rotational movement of the output element can be limited to significantly less than one revolution of the output element. Two receptacles have proven particularly advantageous.

A further embodiment provides that the blocking device advantageously blocks engagement of the starting position when the output element is rotating. As a result, engagement of the starting position during operation, i.e. when the internal combustion engine is operating, can be avoided in a simple manner. A simple configuration is produced when the blocking device has a blocking contour which is connected to the output element for rotation therewith and, when the output element is rotating and when the detent pawl is moved from the unactuated position in the direction of the actuated position thereof, above a structurally predefined rotational speed exerts a force on the detent pawl in the direction of the unactuated position thereof. A simple construction is produced when the blocking contour is adjacent to the receptacle on that side of the receptacle which is on the outside with respect to the axis of rotation and is at the rear in the driving direction. The blocking contour here is connected, in particular fixed, to the output element. At rotational speeds above the structurally predetermined rotational speed, the blocking contour exerts a force on the detent pawl in the direction of the unactuated position of the detent pawl. The blocking contour is advantageously arranged adjacent to the receptacle on that side of the receptacle which is on the outside with respect to the axis of rotation and is at the rear in the driving direction. This results in a simple structural construction. In order to be able substantially freely structurally to predefine the rotational speed at which the blocking contour is effective, provision can also be made for the blocking contour to be formed on a centrifugal weight which is held on the output element and at least partially covers the receptacle at rotational speeds above the structurally predefined rotational speed. The receptacle here is covered at least to the extent that the detent pawl cannot be adjusted into the actuated position thereof or is not kept in the actuated position by the retaining contour.

In yet another embodiment, the starting position of the starting device is advantageously released by actuation of a gas throttle of the work implement. The detent pawl here can still remain in the actuated position thereof. The clutch is in particular a centrifugal clutch, and the output element comprises a clutch drum.

Further objects, features, and advantages of the present application will become apparent form the detailed description of preferred embodiments which is set forth below, when considered together with the figures of drawing.

BRIEF DESCRIPTION OF THE DRAWINGS

Exemplary embodiments of the application will be explained below with reference to the figures of drawing, in which.

DETAILED DESCRIPTION OF PREFERRED EMBODIMENTS

Figure 1:
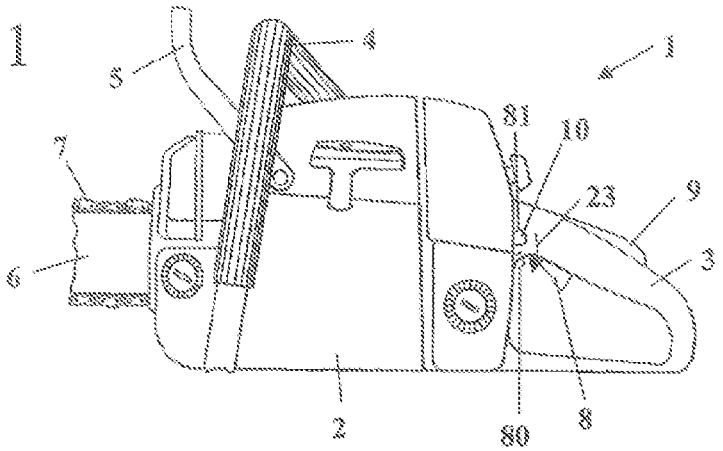
FIG. 1 shows a schematic side view of a work implement.

Turning to the figures of drawing, FIG. 1 shows a hand-guided work implement, namely a motor-driven saw 1, as an exemplary embodiment of a work implement with an internal combustion engine. The motor-driven saw 1 has a housing 2 to which a rear handle 3 and a gripping tube 4 are fixed. In addition, a hand guard 5 which can serve for triggering a chain brake device of the motor-driven saw 1 is mounted pivotably on the housing 2. A guide rail 6, on which a saw chain 7 is arranged in a revolving manner, protrudes forwards on that side of the housing 2 which faces away from the rear handle 3. The saw chain 7 is driven by an internal combustion engine 11, which is shown schematically in FIG. 2. As FIG. 1 shows, a gas throttle 8 and a gas throttle block 9 are mounted pivotably on the rear handle 3. An operating mode selector 10 protrudes from the housing 2 adjacent to the rear handle 3, which operating mode selector can be adjusted in the direction of an arrow 23 from the operating position 81 shown in FIG. 1 into a starting position 80 shown by dashed lines.

Figure 2:
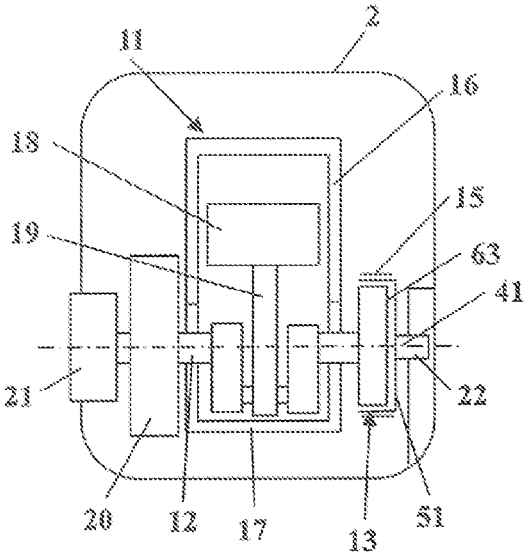
FIG. 2 shows a schematic sectional illustration through the work implement from FIG. 1.

FIG. 2 shows the construction of the drive of the motor-driven saw 1 in detail. The motor-driven saw 1 has a manual starting device 21 which is preferably designed as a pull starter. The manual starting device 21 acts on a crankshaft 12, on which a fan wheel 20 is held for rotation therewith. In the exemplary embodiment, the fan wheel 20 is arranged between the manual starting device 21 and a crank housing 17 of the internal combustion engine 11. The internal combustion engine 11 has a cylinder 16 in which a piston 18 is mounted in a reciprocating manner. The piston 18 guides the crankshaft 12 in a rotating manner via a connecting rod 19. The crankshaft 12 is mounted rotatably about an axis of rotation 41 in the crank housing 17. A clutch 13 which, in the exemplary embodiment, is designed as a centrifugal clutch is arranged on that side of the internal combustion engine 11 which is opposite the fan wheel 20. The clutch 13 is shown schematically in FIG. 2. The clutch 13 has a driving element 63 which comprises at least one centrifugal weight. When a structurally predefined rotational speed of the crankshaft 12 is exceeded, the centrifugal weight moves radially outwards and comes to bear against an output element 51. A brake band 15 which is part of the braking device to be triggered by the hand guard 5 is arranged on the outer circumference of the output element 51. A driving pinion 22 which drives the saw chain 7 is fixed to the output element 51.

Figure 3:
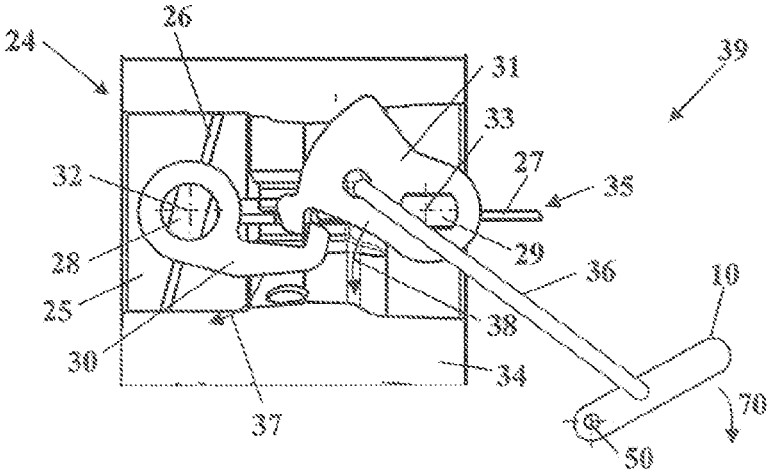
FIG. 3 shows a schematic illustration of a starting device of the work implement in the operating position.

The fuel/air mixture is supplied to the internal combustion engine 11 via a carburetor 24 which is shown in FIG. 3. The internal combustion engine 11 is in particular a single-cylinder engine, advantageously a two-stroke engine. The carburetor 24 has a carburetor housing 34 in which an intake channel section 25 is guided. A throttle flap 26 and a choke flap 27 are mounted pivotably in the intake channel section 25. Instead of the throttle flap 26 and the choke flap 27, other throttle elements can also be provided in the intake channel section 25 formed in the carburetor 24. The throttle flap 26 is mounted with a throttle shaft 28 so as to be pivotable about an axis of rotation 32. The choke flap 27 is mounted with a choke shaft 29 so as to be pivotable about an axis of rotation 33. A throttle lever 30 is fixed to the throttle shaft 28. The throttle lever 30 is advantageously connected to the throttle shaft 28 for rotation therewith. A choke throttle 31 is fixed to the choke shaft 29. The choke throttle 31 can be connected to the choke shaft 29 for rotation therewith, as shown in the exemplary embodiment. However, a small relative movement between the choke throttle 31 and the choke shaft 29 is also possible in order to compensate for tolerances.

The operating mode selector 10 is coupled to the choke lever 31 via a coupling rod 36. The operating mode selector 10 is mounted pivotably here about a pivot axis 50. The operating mode selector 10, the coupling rod 36, the choke throttle 31, the choke shaft 29 and the choke flap 27 are part of a starting device 39. In the position shown in FIG. 3, the starting device 39 is in an operating position 35. In the operating position 35, the choke flap 27 reduces the flow cross section in the intake channel section 25 only slightly, if at all. The choke flap 27 lies approximately parallel to the direction of flow in the intake channel section 25.

Figure 4:
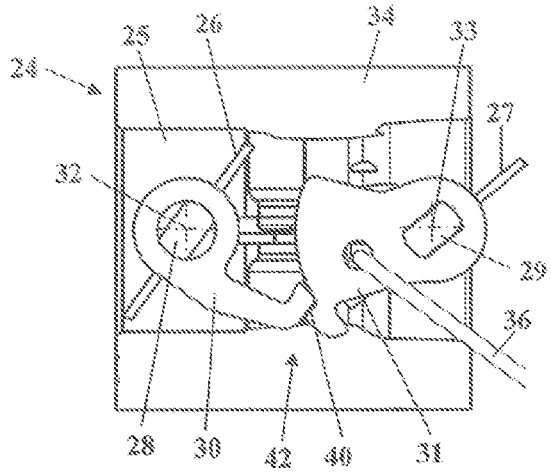
FIG. 4 shows the starting device from FIG. 3 in a starting position.

In order to adjust the starting device 39 from the operating position 35 shown in FIG. 3 into the starting position 32 shown in FIG. 4, the throttle lever 30 is pivoted in the direction of the arrow 37 in FIG. 3. As a result, a section of the throttle lever 30 pivots out of the pivoting path of the choke throttle 31. The throttle lever 30 is pivoted in the direction of the arrow 37 by actuation of the gas throttle 8. The operating mode selector 10 can subsequently be pivoted in the direction of the arrow 70. As a result, the choke throttle 31 pivots in the direction of the arrow 38 into the starting position 42 shown in FIG. 4. If the gas throttle 8 is removed when the operating mode selector 10 is actuated, the throttle lever 30 latches to the choke throttle 31. In the process, the throttle lever 30 bears against a shoulder 40 of the choke throttle 31. In the starting position 42 shown in FIG. 4, the throttle flap 26 is slightly open and the choke flap 27 is furthermore closed in relation to the operating position 35. Throttle flap 26 and choke flap 27 are in a position in which the quantity of combustion air supplied to the internal combustion engine 11 and the quantity of fuel supplied to the internal combustion engine 11 are coordinated with the consumption of air and the fuel requirement on starting the internal combustion engine 11, i.e. when actuating the manual starting device 21. Provision can also be made for only the choke throttle 31 to have to be actuated and for the latter to set the throttle lever 30 into a starting position.

Figure 5:
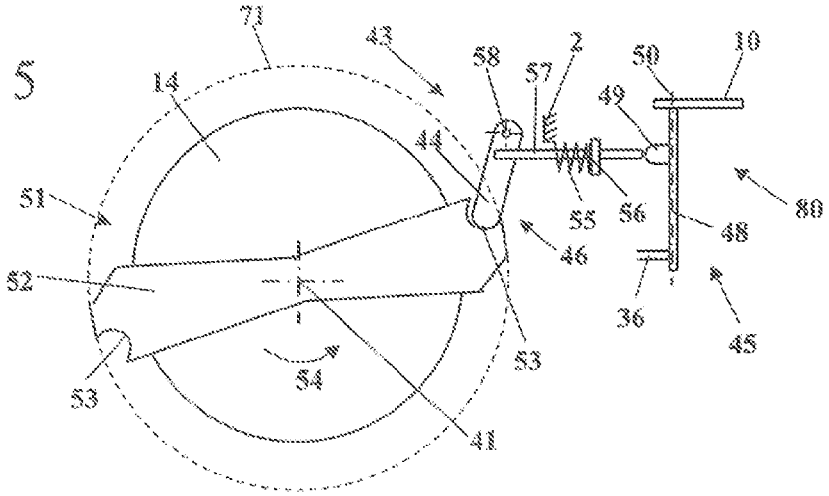
FIG. 5 shows a schematic illustration of a blocking device of the work implement in an actuated position of a detent pawl.

In order to avoid the tool, i.e. the saw chain 7, being able to move during a starting of the internal combustion engine 11, a blocking device 43 which is shown schematically in FIG. 5 is provided. The blocking device 43 comprises a detent pawl 44 which is mounted pivotably about a pivot axis 58 and interacts with a receptacle 53 on the output element 51. The output element 51 comprises a clutch drum 14. A retaining plate 52 which projects on opposite sides over the outer circumference of the clutch drum 14 and which has a respective receptacle 53 for the detent pawl 44 on both sides is fixed to the clutch drum 14. A different structural arrangement of one or more receptacles 53 may also be advantageous. The output element 51 is driven in a driving direction 54 by the internal combustion engine 11. FIG. 5 shows the detent pawl 44 in the actuated position 46 thereof. In this position, the detent pawl 44 projects into the movement path 71, which is shown by dashed lines in FIG. 5, of the output element 51. The movement path 71 here is the circle which that region of the output element 51 which is furthest away from the axis of rotation 41 describes in the region of the receptacle 53 during rotation about the axis of rotation 41.

Figure 7:
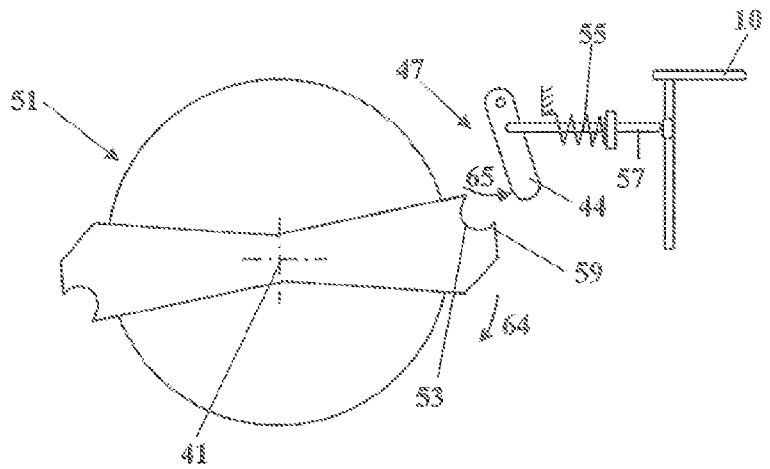
FIG. 7 shows the blocking device from FIGS. 5 and 6 in an unactuated position of the detent pawl.

An actuating element 57 acts on the detent pawl 44. The actuating element 57 is acted upon by a resetting spring in the direction of an unactuated position 47 of the detent pawl 44 that is shown in FIG. 7. In the schematic illustration in FIG. 5, the resetting spring 55 is supported at one end on a counter bearing 56, which is connected fixedly to the actuating element 57. The other end of the spring 55 is connected fixedly to the housing 2.

In the exemplary embodiment, the operating mode selector 10 is connected fixedly to a bearing shaft 48 and is mounted pivotably about the pivot axis 50. An actuating drum 49 which acts on the actuating element 57 is fixed to the bearing shaft 48. The operating mode selector 10 together with the bearing shaft 48 and the actuating pin 49 forms an actuating device 45 for the blocking device 43. FIG. 5 shows the operating mode selector 10 in the starting position 80 thereof. In the starting position 80 of the operating mode selector 10, the starting device 39 is in the starting position 42 thereof (FIG. 4). In the starting position 80 of the operating mode selector 10, the actuating pin 49 pushes the detent pawl 44 into the actuated position 46 counter to the force of the spring 55.

Figure 6:
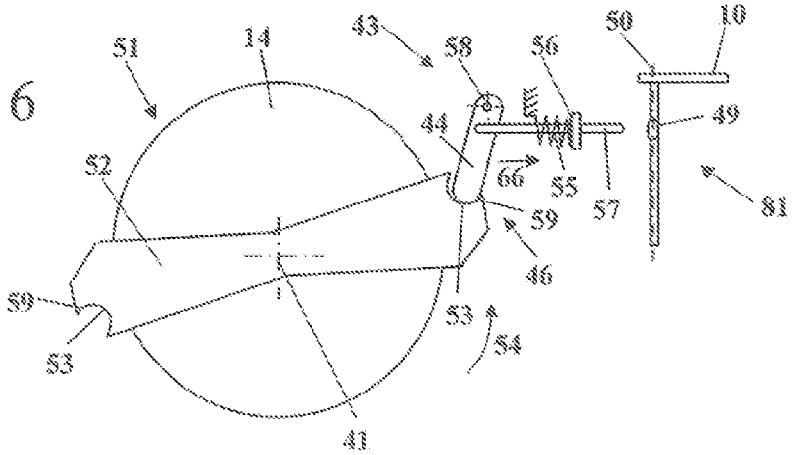
FIG. 6 shows the blocking device from FIG. 5 with the actuating device in an operating position.

If the starting position 42 is released by acceleration, the latching shown in FIG. 4 between the throttle lever 30 and the choke throttle 31 is released. The operating mode selector 10 is adjusted into the operating position 81 thereof shown in FIG. 6 owing to the force of a spring (not shown). Provision may also be made for the operating mode selector 10 to be reset by the operator from the starting position 80 shown in FIG. 5 into the operating position 81 shown in FIG. 6. As FIG. 6 shows, a retaining contour 59 is formed on the receptacle 53. The retaining contour 59 is adjacent to the receptacle 53 at the region which is located on the outside radially with respect to the axis of rotation 41 and is at the rear in the driving direction 54, and lies in the pivoting path of the detent pawl 44 from the actuated position 46 into the unactuated position 47 shown in FIG. 7. The detent pawl 44 is spring-loaded by the spring 55 in the direction of the unactuated position 47. The spring force is indicated in FIG. 6 by the arrow 66. As soon as the output element 51 is loaded in the driving direction 54, pivoting of the blocking contour 44 into the unactuated position 47 is prevented by the retaining contour 59.

FIG. 7 shows the arrangement according to which the output element 51 is no longer loaded in the driving direction 54. This can take place, for example, by the operator releasing the gas throttle 8 and the internal combustion engine 11 being operated at idling. The idling rotational speed is below the coupling rotational speed of the clutch 13, and therefore the output element 51 of the clutch 13 is not driven further. Owing to the force of the spring 55, the detent pawl 44 is pivoted in a pivoting direction 65 into the unactuated position 47 thereof. The detent pawl 44 has exerted a force on the retaining contour 59 in the process, and the output element 51 moves slightly in a direction of rotation 64 opposed to the driving direction 54. The retaining contour 59 has the effect that the detent pawl 44 remains in the actuated position 46 thereof until a torque no longer acts on the output element in the driving direction 54. As a result, an abrupt starting of the tool when adjusting the starting device 39 into the operating position 35 can be prevented.

Figure 8:
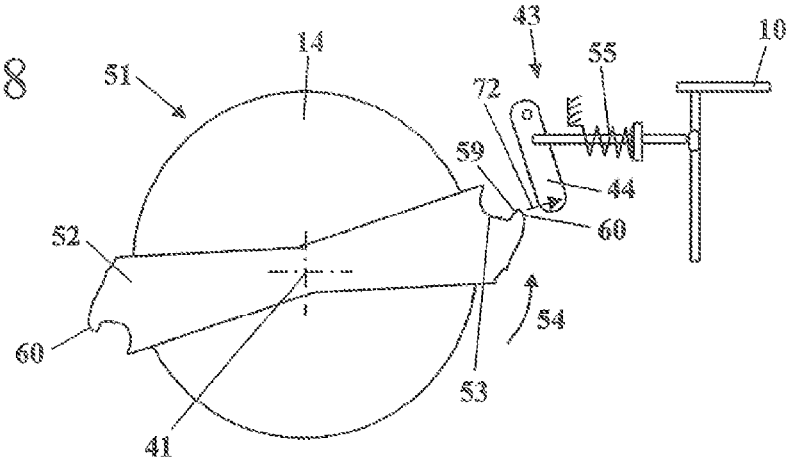
FIG. 8 and FIG. 9 show exemplary embodiments of blocking devices in an unactuated position of the detent pawl.

In the exemplary embodiment shown in FIG. 8, a blocking contour 60 is formed adjacent to the retaining contour 59 on the receptacle 53. The blocking contour 60 is arranged adjacent to the receptacle 53 on that side of the receptacle 53 which is located radially on the outside with respect to the axis of rotation 41 and at the rear with respect to the driving direction 54. When the output element 51 rotates in the driving direction 54, the blocking contour exerts a force in the direction of the arrow 72, i.e. radially outwards with respect to the axis of rotation 41, on a detent pawl 44 moving from the unactuated position 47 in the direction of the actuated position 46 thereof (FIG. 6). Above a structurally predefined rotational speed, the blocking contours 60 formed at the two ends of the retaining plate 52 that protrude over the clutch drum 14 follow each other so rapidly that the blocking contour 44 can no longer be pivoted into the actuated position 46. As a result, the operating mode selector 10 cannot be adjusted into the starting position 80 thereof. An adjustment of the starting device 39 into the starting position 42 when the output element 51 is rotating is thereby prevented.

Figure 9:
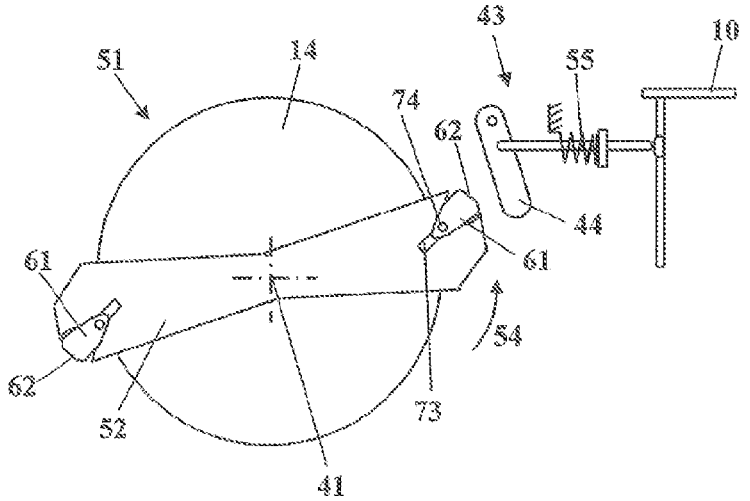

In the alternative embodiment shown in FIG. 9, centrifugal weights 61 are mounted on the output element 51 adjacent to the receptacles 53. In the outwardly adjusted position of the centrifugal weights 61 that is shown in FIG. 9, the centrifugal weights 61 at least partially close the receptacles 53. In the exemplary embodiment, the receptacles 53 are virtually completely closed. The centrifugal weights 61 each have a blocking contour 62 which closes a receptacle 53. As a result, an adjustment of the detent pawl 44 into the actuated position 46 shown in FIG. 6 is prevented. The centrifugal weights 61 are connected to the retaining plate 52 via a respective bolt 74 which projects into a groove 73. The groove 73 runs in an inclined manner to the radial direction with respect to the axis of rotation 41. The rotational speed above which the adjustment of the detent pawl 44 into the actuated position 46 is prevented can be set via a corresponding configuration of the angle of inclination of the groove 73 and of the weight of the centrifugal weight 61.

Figure 10:
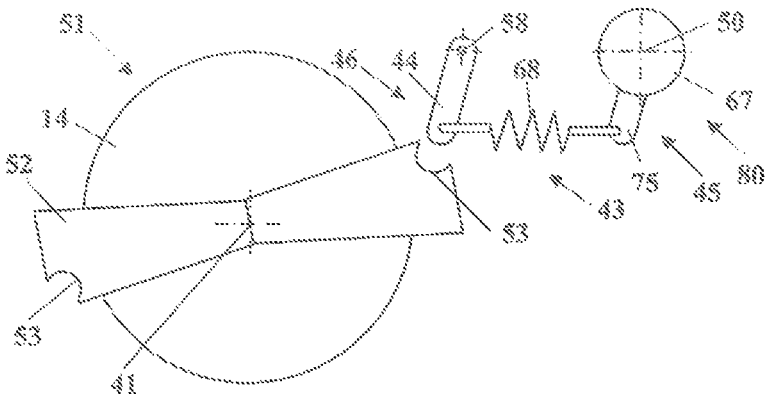
FIG. 10 shows an exemplary embodiment of the blocking device in an actuated position of the detent pawl.
Figure 11:
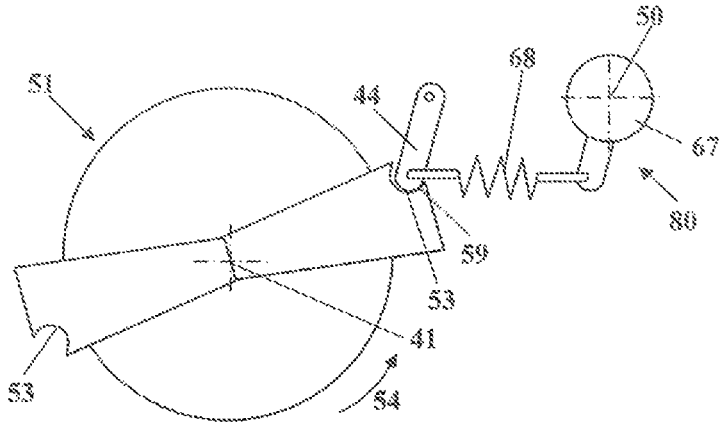
FIG. 11 shows the blocking device from FIG. 10 with the output element blocked.

FIG. 10 shows an exemplary embodiment of a blocking device 43. The design of the output element 51 corresponds to the design of the output element from FIGS. 5 to 7. A design according to the exemplary embodiment in FIG. 8 or according to the exemplary embodiment in FIG. 9 with a blocking contour 60 or 62 may also be advantageous. The same reference numbers indicate mutually corresponding elements in all of the figures. The actuating device 45 of the exemplary embodiment shown in FIG. 10 comprises, instead of an operating mode selector 10, a rotary knob 67 which is mounted rotatably about the pivot axis 50. The rotary knob 67, in addition to the rotatability thereof, is advantageously displaceable longitudinally in the direction of the pivot axis 50. A projecting arm 75, to which one end of a damping spring 68 is fixed, is arranged on the rotary knob 67. The other end of the damping spring 68 is connected to the detent pawl 44. The damping spring 68 is designed as a tension spring. A different structural arrangement and design of a damping spring 68 acting between the rotary knob 67 and the detent pawl 44 can also be advantageous. In FIG. 10, the detent pawl 44 is in an actuated position 46. The rotary knob 67 is in the starting position 80. If the output element 51 is driven in the driving direction 54, the detent pawl 44 hooks into the receptacle 53 and thereby prevents further rotation of the receptacle 53. The output element 51 is blocked. This is shown in FIG. 11.

Figure 12:
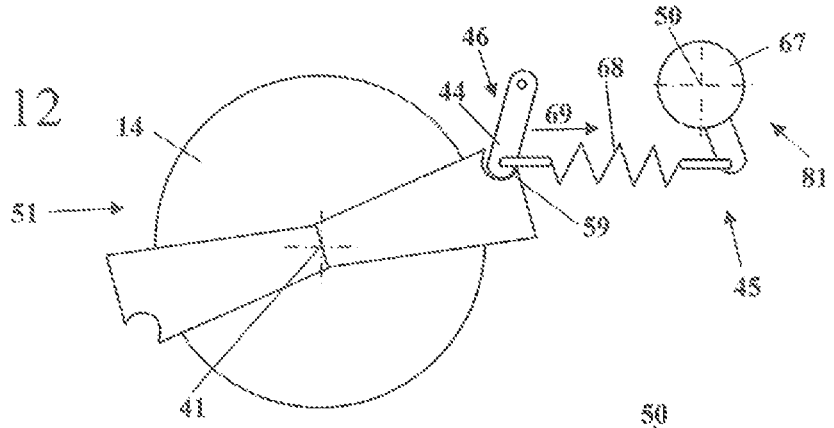
FIG. 12 shows the blocking device from FIG. 11 with the actuating device in the operating position.

If the rotary knob 67 is adjusted from the starting position 81 into the operating position 80 shown in FIG. 12, the damping spring 68 is tensioned. The detent pawl 44 is kept in the actuated position 46 thereof by the retaining contour 59 as long as the output element 51 is driven in the driving direction 54. The force of the damping spring 68 acts on the detent pawl 44, as the arrow 69 shows. As soon as the output element 51 is no longer loaded in the driving direction 54, the detent pawl 44 can rotate the output element 51 at the retaining contour 59 in the direction of rotation 64 shown in FIG. 13 until the detent pawl 44 is released and, owing to the force of the damping spring 68, reset into the unactuated position 47, which is shown in FIG. 13.

Figure 13:
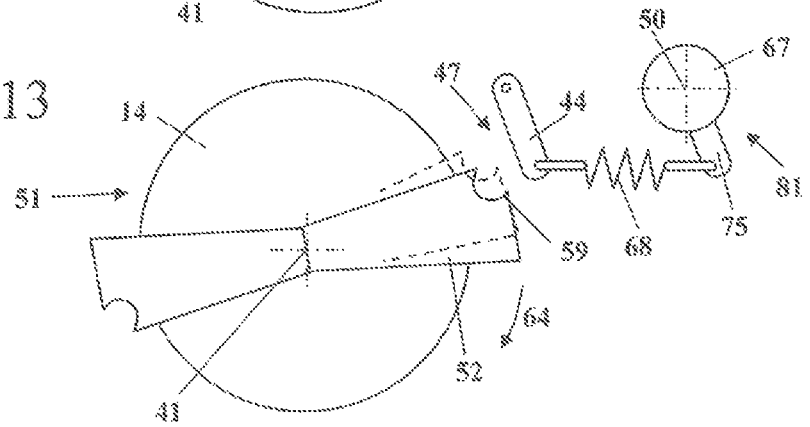
FIG. 13 shows the blocking device from FIG. 12 with the detent pawl in an unactuated position.

If the rotary knob 67 is rotated from the operating position 81 shown in FIG. 13 into the starting position 80 shown in FIG. 10, the detent pawl 44 is pivoted in the direction of the actuated position 46 shown in FIG. 10. If, during this pivoting movement, the output element 51 rotates in the driving direction 54, those ends of the retaining plate 52 which project beyond the clutch drum 14 strike against the detent pawl 44 (FIGS. 8, 9). These impacts are mitigated by the damping spring 68. If a retaining plate, as shown by dashed lines in FIG. 13, stands in the pivoting path of the detent pawl 44, the rotary knob 67 can nevertheless be adjusted into the starting position 80 thereof. The damping spring 68 is tensioned in the process. If the output element 51 moves about the axis of rotation 41, the detent pawl 44 can pivot into the actuated position 46 thereof owing to the force of the spring 68. As a result, the adjustment of the starting device 39 into the starting position 42 is possible in every rotational position of the output element 51.

Figure 14:
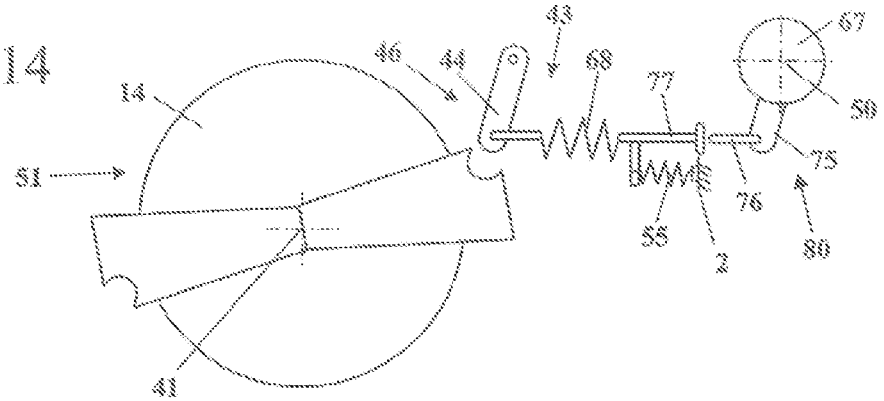
FIG. 14 to FIG. 17 show a further exemplary embodiment of a blocking device in positions corresponding to FIGS. 10 to 13.

FIGS. 14 to 17 show an exemplary embodiment in which both a damping spring 68 and a resetting spring 55 are provided. A first actuating element 76 which, in the starting position 80 of the rotary knob 67 that is shown in FIG. 14, bears against a second actuating element 77 is fixed to the arm 75 of the rotary knob 67. The first actuating element 76 and the second actuating element 77 merely bear against each other, and therefore only compressive forces, but no tensile forces, can be transmitted between the actuating elements 76 and 77. The second actuating element 77 acts via the damping spring 68 on the detent pawl 44, which is arranged in the actuated position 46 thereof in FIG. 14. The resetting spring 55 acts between the second actuating element 77 and the housing 2 on an element connected to the housing 2.

Figure 15:
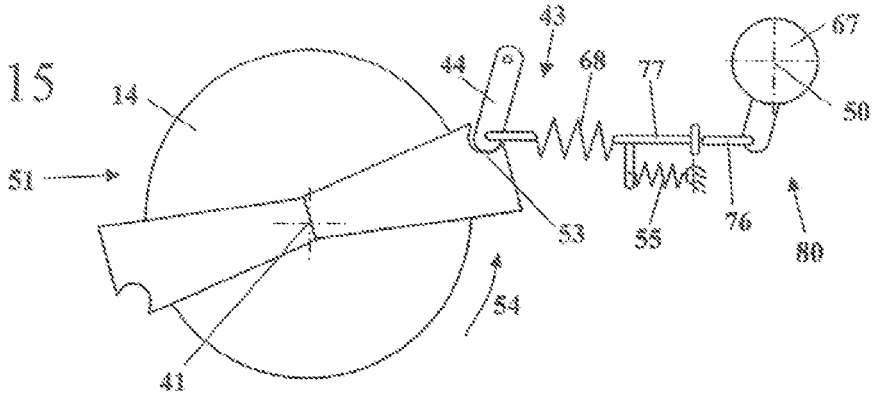
Figure 16:
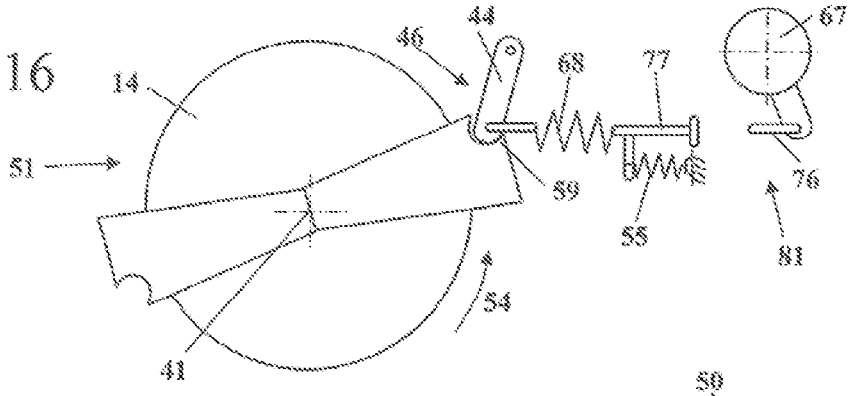
Figure 17:
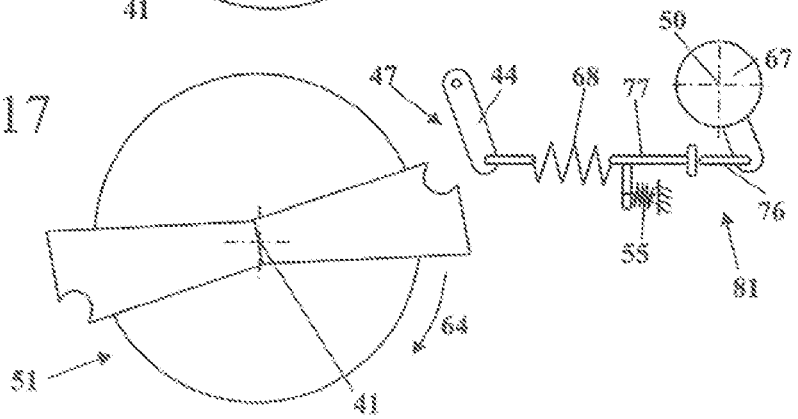

FIG. 15 shows the arrangement after rotation of the output element 51 in the driving direction 54. In this position, the detent pawl 44 bears against the receptacle 53 on the output element 51 and thereby blocks further rotation of the output element 51. As a result of the fact that two receptacles 53 are arranged opposite each other, the output element 51, in the actuated position 46 of the detent pawl 44, can rotate through at most barely 180° until the detent pawl 44 comes to rest in a receptacle 53 and thereby blocks the output element 51. If the rotary knob 67 is adjusted from the starting position 80 shown in FIG. 15 into the operating position 81 shown in FIG. 16, the first actuating element 76 is reset. The second actuating element 77 can follow the movement of the first actuating element 76 or can travel a smaller amount or no amount. This is dependent on the configuration of the resetting spring 55 and of the damping spring 68. The detent pawl 44 is in the actuated position 46 thereof, because said detent pawl is fixed by the blocking contour 59 as long as the output element 51 is driven in the driving direction 54. As soon as the output element 51 is no longer driven in the driving direction 54, the detent pawl 44 is reset into the unactuated position 47 shown in FIG. 17 owing to the force of the springs 68 and 55. The driving element 51 is rotated here in the opposite direction 64 until the detent pawl 44 comes free.

In the exemplary embodiment in FIGS. 14 to 17, the starting device 39 can be reset into the operating position from the starting position 80 independently of the position of the detent pawl 44. Owing to the decoupling of the two actuating elements 76 and 77, the damping spring 68 does not exert any force on the rotary knob 67 even if the detent pawl 44 is in the actuated position 46 thereof. As a result, the release of the starting position 42 of the starting device 39 is not obstructed by the blocking device 43. The blocking device 43 comprises the receptacle 53, the detent pawl 44 and the actuating elements 76, 77, 57, which are arranged in operative connection between the detent pawl 44 and the operating mode selector 10 or the rotary knob 67, and springs 55, 68.

The foregoing description of preferred embodiments of the application has been presented for purposes of illustration and description only. It is not intended to be exhaustive or to limit the application to the precise form disclosed, and modifications and variations are possible and/or would be apparent in light of the above teachings or may be acquired from practice of the application. The embodiments were chosen and described in order to explain the principles of the application and its practical application to enable one skilled in the art to utilize the application in various embodiments and with various modifications as are suited to the particular use contemplated. It is intended that the scope of the application be defined by the claims appended hereto and that the claims encompass all embodiments of the application, including the disclosed embodiments and their equivalents.

The invention claimed is:

1. A work implement comprising an internal combustion engine which drives at least one tool of the work implement via a centrifugal clutch, wherein the centrifugal clutch has at least one driving element which is operatively connected to the internal combustion engine and at least one output element which is operatively connected to the tool, wherein the output element comprises a clutch drum of the centrifugal clutch, and wherein the work implement has a starting device for the internal combustion engine, the starting device having a starting position and an operating position, wherein the work implement has a blocking device with a detent pawl which, in an actuated position, projects into the movement path of the output element and limits the rotation of the output element to less than one revolution and which, in an unactuated position, releases the output element, and in that the starting device has an actuating device for the blocking device which, in the starting position of the starting device, keeps the detent pawl in the actuated position.

2. The work implement according to claim 1, wherein the blocking device is adjusted into the actuated position when the starting position is engaged.

3. The work implement according to claim 1, wherein the detent pawl is mounted pivotably.

4. The work implement according to claim 1, wherein the detent pawl is spring-loaded by a resetting spring in the direction of the unactuated position of the blocking device, and in that the starting device adjusts the detent pawl into the actuated position counter to the force of the resetting spring.

5. The work implement according to claim 1, wherein a damping spring is arranged in an operative connection between the actuating device and the detent pawl.

6. The work implement according to claim 1, wherein the actuating device has a starting position associated with the starting position of the starting device and an operating position associated with the operating position of the starting device, and in that the actuating device is adjustable into the operating position independently of the position of the detent pawl.

7. The work implement according to claim 1, wherein the blocking device has a retaining contour which keeps the detent pawl in the actuated position independently of the position of the starting device when the output element is loaded in the driving direction.

8. The work implement according to claim 1, wherein the detent pawl interacts with a receptacle of the output element when the output element is blocked.

9. The work implement according to claim 8, wherein the output element has a plurality of receptacles arranged in a rotationally symmetrical manner with respect to the axis of rotation of the output element.

10. The work implement according to claim 8, wherein the blocking device blocks engagement of the starting position when the output element is rotating.

11. The work implement according to claim 8, wherein the blocking device has a blocking contour which is connected to the output element for rotation therewith and, when the output element is rotating and when the detent pawl is moved from the unactuated position in the direction of the actuated position thereof, above a structurally predefined rotational speed exerts a force on the detent pawl in the direction of the unactuated position thereof.

12. The work implement according to claim 11, wherein the blocking contour is adjacent to the receptacle on that side of the receptacle which is on the outside with respect to the axis of rotation and is at the rear in the driving direction.

13. The work implement according to claim 1, wherein the starting position of the starting device is released by actuation of a gas throttle) of the work implement.

14. A work implement comprising an internal combustion engine which drives at least one tool of the work implement via a clutch, wherein the clutch has at least one driving element which is operatively connected to the internal combustion engine and at least one output element which is operatively connected to the tool, and wherein the work implement has a starting device for the internal combustion engine, the starting device having a starting position and an operating position, wherein the work implement has a blocking device with a detent pawl which, in an actuated position, projects into the movement path of the output element and limits the rotation of the output element to less than one revolution and which, in an unactuated position, releases the output element, and in that the starting device has an actuating device for the blocking device which, in the starting position of the starting device, keeps the detent pawl in the actuated position, wherein the detent pawl interacts with a receptacle of the output element when the output element is blocked, wherein the blocking device has a blocking contour which is connected to the output element for rotation therewith and, when the output element is rotating and when the detent pawl is moved from the unactuated position in the direction of the actuated position thereof, above a structurally predefined rotational speed exerts a force on the detent pawl in the direction of the unactuated position thereof, wherein the blocking contour is formed on a centrifugal weight which is held on the output element and at least partially covers the receptacle at rotational speeds above the structurally predefined rotational speed.

* * * * *